United States Patent [19]

Hibino et al.

[11] 4,142,491

[45] Mar. 6, 1979

[54] EXHAUST GAS RECIRCULATION APPARATUS FOR AN INTERNAL COMBUSTION ENGINE

[75] Inventors: Masaru Hibino, Okazaki; Michio Morishita, Toyota, both of Japan

[73] Assignee: Toyota Jidosha Kogyo Kabushiki Kaisha, Toyota, Japan

[21] Appl. No.: 799,916

[22] Filed: May 24, 1977

[30] Foreign Application Priority Data

Dec. 9, 1976 [JP] Japan ..... 51-147092

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,977,381 | 8/1976 | Fujikawa et al. | 123/119 A |
| 4,031,871 | 6/1977 | Hamanishi | 123/119 A |
| 4,048,967 | 9/1977 | Stumpp | 123/119 A |
| 4,061,119 | 12/1977 | Takeshita | 123/119 A |
| 4,069,798 | 1/1978 | Thornburgh | 123/119 A |

*Primary Examiner*—Carlton R. Croyle
*Assistant Examiner*—Michael Koczo, Jr.
*Attorney, Agent, or Firm*—Stevens, Davis, Miller & Mosher

[57] ABSTRACT

An exhaust gas recirculation apparatus of the so-called exhaust gas pressure control type, including, in combination, a vacuum-operated pressure control valve adapted for controlling the pressure of the exhaust gas in the exhaust gas recirculation passageway connecting the exhaust manifold to the intake manifold, and a vacuum control valve adapted for controlling the level of the vacuum signal transmitted to the pressure control valve, for obtaining a predetermined constant pressure in the exhaust gas directed to the pressure control valve. A flow control valve is provided for controlling the amount of exhaust gas directed to the pressure control valve in accordance with the load of the engine. The flow control valve has an exhaust gas passageway with a constant flow area, and another exhaust gas passageway with a flow area that is varied in accordance with the load of the engine.

8 Claims, 5 Drawing Figures

EXHAUST GAS RECIRCULATION APPARATUS FOR AN INTERNAL COMBUSTION ENGINE

FIELD OF THE INVENTION

The present invention relates to an exhaust gas recirculation apparatus of the so-called exhaust gas pressure control type.

BACKGROUND OF THE INVENTION

In an exhaust gas recirculation apparatus of the so-called exhaust gas pressure control type, the pressure of the exhaust gas in the exhaust gas recirculation passageway connecting the exhaust manifold to the intake manifold can be maintained at a predetermined constant value for every type of engine load condition. Therefore, the ratio of the amount of the inert exhaust gas introduced into the intake manifold to the amount of total gas (including air-fuel mixture and the recirculated exhaust gas) introduced into the engine combustion chamber, which is called the external EGR ratio, is controlled to a predetermined constant value for every type of engine load condition, as is well known to those who are skilled in this art.

However, an ideal exhaust gas recirculation operation cannot be performed only by controlling the external EGR ratio to said predetermined value, due to the existence of the inert combustion gas which remains in the combustion chambers of the engine without being exhausted. In this case, the ratio of the amount of the inert combustion gas remaining in the combustion chambers, to the amount of the total gas introduced into the combustion chambers, which is called the internal EGR ratio, is decreased in accordance with an increase in the load of the engine. Due to this fact, the so-called required EGR ratio cannot be controlled to a predetermined value, which is a ratio of the amount of the inert gas introduced into the intake manifold from the exhaust manifold and remaining in the combustion chambers, to the amount of the total gas introduced into the combustion chambers.

To maintain the required EGR ratio to a predetermined constant value an exhaust gas recirculation apparatus has heretofore been provided, wherein a flow control valve is arranged on the exhaust gas recirculation passageway to control the amount of exhaust gas in such a manner that the external EGR ratio is increased in accordance with an increase in the load of the engine. The required EGR ratio can therefore be controlled to a predetermined constant value. The flow control valve has a spring-urged diaphragm connected to a valve member facing a valve seat. To a vacuum chamber formed on one side of the spring-urged diaphragm, a vacuum signal corresponding to the engine load is transmitted to control the distance between the valve member and the valve seat for controlling the amount of exhaust gas, which corresponds to the external EGR ratio, in accordance with the engine load.

However, this type of exhaust gas recirculation apparatus exhibits drawbacks wherein the required EGR ratio is apt to be decreased during low load conditions due to the use of a single-flow control mechanism comprised of the spring-urged diaphragm, the valve member and the valve seat, and wherein parts with high accuracy are necessary for obtaining a required constant EGR ratio during every type of load conditions.

SUMMARY OF THE INVENTION

An object of the present invention is to provide an exhaust gas recirculation apparatus of the so-called exhaust gas pressure control type, which is capable of eliminating the above-mentioned drawbacks in the known art.

Another object of the present invention is to provide a flow control valve for the exhaust gas recirculation apparatus of the so-called exhaust gas pressure control type, which valve is capable of controlling the required EGR ratio to a predetermined constant value during relatively low load conditions.

Still another object of the present invention is to provide a flow control valve wherein no parts requiring high accuracy are necessary.

According to the present invention, an exhaust gas recirculation apparatus for an internal combustion engine comprises: a pressure control valve which is arranged on a passageway means connecting the exhaust system of the engine with the intake system of the engine and which is operated by a vacuum signal transmitted from the intake system into the pressure control valve; and a vacuum control valve adapted for controlling the level of the vacuum signal which is transmitted to the pressure control valve in such a manner that the pressure of the exhaust gas to be directed to the pressure control valve is controlled to a predetermined constant value. The apparatus further comprises a flow control valve arranged on the passageway means at a position located between the pressure control valve and the exhaust system, which flow control valve comprises a body; a valve seat arranged across the interior of the body; a valve member facing the valve seat; a diaphragm actuator connected to the valve member for moving the valve member with respect to the valve seat in accordance with the level of the vacuum signal transmitted to the diaphragm actuator from the intake system, so that a first exhaust gas passageway, the cross-sectional area of which is varied in accordance with the level of the vacuum signal, is formed between the valve member and the valve seat, and an orifice means for forming a second exhaust gas passageway with a constant, relatively small cross-sectional area, which passageway being parallelly arranged with respect to the first exhaust gas passageway in said body. Thus, the amount of the exhaust gas directed to the pressure control valve via the first and said second exhaust gas passageways in controlled to vary in accordance with the load of the engine.

DESCRIPTION OF PREFERRED EMBODIMENTS

Figure 1:
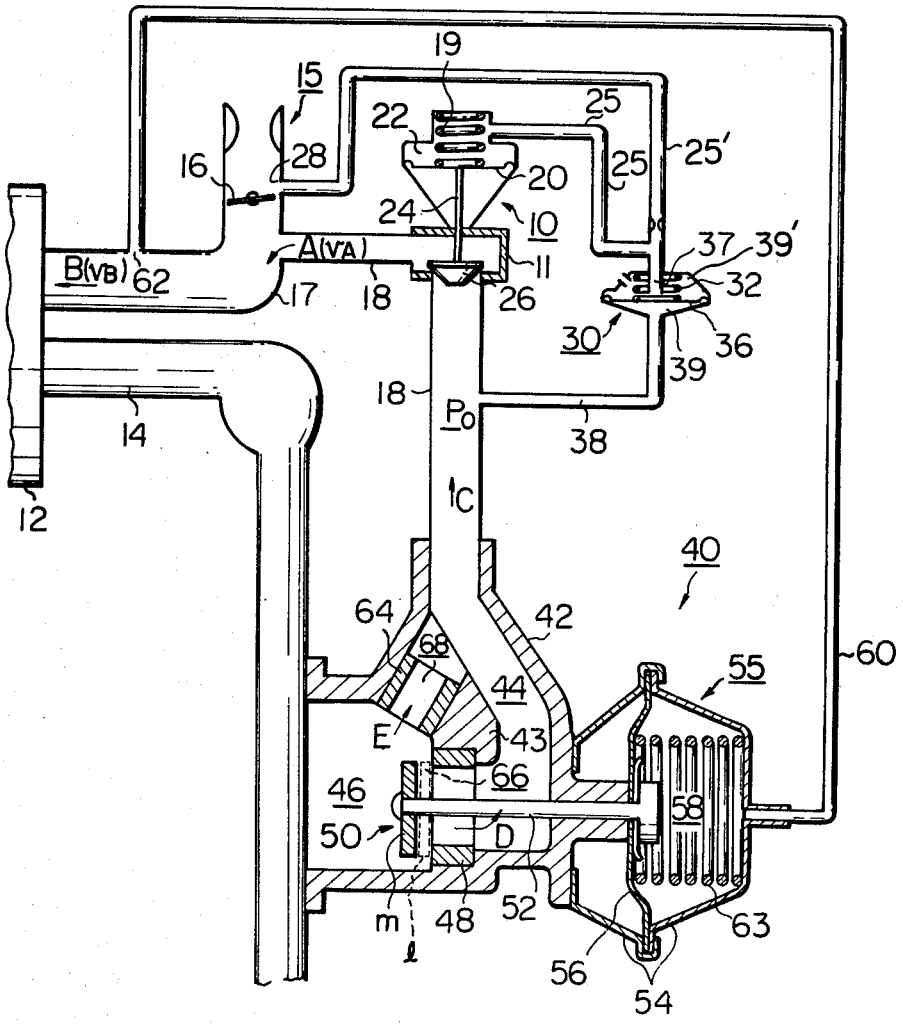
FIG. 1 is a schematic view of the EGR apparatus of the exhaust gas pressure control type, provided with a flow control valve according to the present invention.

FIG. 1 shows a first embodiment of an exhaust gas recirculation apparatus of the so-called exhaust gas pressure control type which includes, in combination, a pressure control valve 10 and a vacuum control valve 30. The pressure control valve 10 has a valve body 11 located between pipes 18 and 18'. The pipe 18 is connected to an intake manifold 17 adapted for introducing the air-fuel mixture into an engine body 12, whereas the pipe 18' is, as will be fully described later, associated with an exhaust manifold 14 adapted for receiving exhaust gas from the engine body 12. A valve member 26 is arranged in the valve body 11 in order to control the pressure of exhaust gas in the pipe 18'. The valve member 26 is connected, via a rod 24, to a diaphragm 20 which is downwardly urged by a spring 19. A vacuum signal chamber 22, formed on an upper side of the diaphragm 20, is connected, via vacuum signal tubes 25 and 25', to a vacuum port 28 (so-called ERG port) formed in the carburetor 15 of the engine at a position located slightly above a throttle valve 16 which is in its idle position.

The vacuum control valve 30 operates to control the level of the vacuum signal transmitted to the vacuum chamber 22 from the EGR port 28. The vacuum control valve 30 has a diaphragm 36 which is downwardly urged by a spring 32. An exhaust gas pressure chamber 39, which is formed on one side of the diaphragm 36, is connected to the pipe 18' via an exhaust gas pressure signal tube 38. Another chamber 39', which is formed on the other side of the diaphragm 36, is opened to the atmosphere. One end of a vacuum control tube 37 is connected to the tubes 25 and 25'. The other end of the tube 37 faces the diaphragm 36.

The diaphragm 36 is contacted by the vacuum control tube 37 to prevent communication of the tube 37 with the chamber 39' when the pressure P of the exhaust gas in the pipe 18' is higher than the predetermined value $P_o$. Thus, a vacuum signal is allowed to be transmitted from the EGR port 28 to the vacuum chamber 22, so that the valve member 26 is displaced upwardly to decrease to pressure P toward $P_o$. The diaphragm 36 is detached from the vacuum control tube 37 to cause communication of the tube 37 with the chamber 39' when the pressure P is lower than the predetermined value $P_o$. Thus, the vacuum signal is not allowed to be transmitted from the EGR port 28 to the chamber 22, so that the valve member 26 is displaced downwardly to increase the pressure P toward $P_o$.

As is clear from the above description, the exhaust gas recirculation apparatus of the so-called exhaust gas pressure control type, which comprises, in combination, the pressure control valve 10 and the vacuum control valve 30, operates to maintain a predetermined constant pressure Po of the inert exhaust gas in the pipe 18', which permits, as is well known to those who are skilled in this art, the maintaining of a predetermined constant external EGR ratio in every type of engine load, which external EGR ratio is the ratio of the amount of the exhaust gas $V_A$, introduced into the intake manifold 17 from the pipe 18, as shown by an arrow A, to the amount of the total gas $V_B$ including the air-fuel mixture and the recirculated gas 1 introduced into the engine body 12, as shown by an arrow B. However, since the internal EGR ratio, which is the ratio of the amount of the inert combustion gas $V_A'$ remaining in the engine body 12 without being discharged into the exhaust manifold 14 after the exhaust cycle has been performed to the amount of the total gas $V_B$ introduced into the engine body, 12, is decreased in accordance with an increase in the engine load as is well known to those who are skilled in this art, it is necessary to control the external EGR ratio ($=V_A/V_B$) in such a manner that the external EGR ratio is increased in accordance with an increase in the engine load, as shown by the solid line a in FIG. 2. By this control of the external EGR ratio, the required EGR ratio (which is expressed by the equation $(V_A + V_A')/V_B$) can be controlled to a predetermined value for every type of engine load.

In FIG. 1, numeral 40 designates a flow control valve adapted for controlling the amount of exhaust gas directed to the pressure control valve 10, as shown by an arrow C, in such a manner that the external EGR ratio ($=V_A/V_B$) is increased in accordance with the load. The flow control valve 40 has a valve body 42. A partition wall 43 is formed across the interior of the body 42 to provide a chamber 44 on one side thereof and another chamber 46 on the other side thereof. The chamber 44 communicates with the pipe 18', whereas the chamber 46 communicates with the exhaust manifold 14. A valve seat 48 of a tubular shape is press-fitted to an opening formed in the wall 43 so that a first exhaust gas passageway 66 is formed to communicate the chamber 46 with the chamber 44. A valve member 50 is arranged in the chamber 46 so that it faces the valve seat 48. The valve member 50 is connected to a diaphragm actuator 55 via a rod 52. The diaphragm actuator 55 has a casing 54 secured to the body 42, a diaphragm arranged across the interior of the casing 54 and secured to one end of the rod, and a spring 63 urging the diaphragm 56 toward the body 42. A vacuum signal chamber 58, formed on one side of the diaphragm remote from the body 42, is connected to a vacuum port 62 formed in the intake manifold 17 via a vacuum signal tube 60. Therefore, the distance between the valve member 50 and the valve seat 48 is controlled in accordance with the vacuum level at the chamber 58, which level is proportional to the engine load. Therefore, a first exhaust gas passageway 66 with a variable flow area is formed between the valve seat 48 and the valve member 50 to allow the exhaust gas be passed to pass through the valve seat as shown by an arrow D.

According to the present invention, a tubular pipe 64 of a relatively small dimension is fitted to an opening formed in the wall 43 so that a second exhaust gas passageway 68 with a constant flow area is formed to communicate the chamber 46 with the chamber 44, and that a relatively small amount of exhaust gas is permitted to pass through the passageway 68, as shown by an arrow E.

The operation of the herein-above described apparatus is as follows.

When the engine is operating under a low load the opening of the throttle valve 16 is small, thereby forming a high vacuum in the intake manifold 17 located downstream of the throttle valve 16. Thus, a vacuum signal of a high level is transmitted to the chamber 58 of the flow control valve 40, which causes the diaphragm 56 to be displaced against the spring 63 until the valve member 50 is rested on the valve seat 48 as shown by the dashed line l. The exhaust gas from the chamber 46, communicating with the exhaust manifold 14, can thereby be introduced into the chamber 44 via only the second exhaust gas passageway 68 with a constant cross-sectional area, as shown by the arrow E. The external EGR ratio during this low load operation, which corresponds to the amount of exhaust gas directed to the pressure control valve 10 from the chamber 44 of the flow control valve 40 as shown by the arrow C, is kept to a substantially constant value, as shown by the dashed line $b_1$ in FIG. 2.

When the opening of the throttle valve 16 is increased due to the fact that the load of the engine is larger than a predetermined value $e_o$ (FIG. 2), the level of the vacuum signal transmitted to the chamber 58 from the port 62 is decreased so that diaphragm 56 is displaced toward the valve body 42 by the force of the spring 63, which causes the valve member 50 to be detached from the valve seat 48, as shown by a solid line m in FIG. 1. The distance between the valve seat 48 and the valve member 50 is increased in accordance with the decrease of the level of vacuum signal in the chamber 58, in other words, with the increase of the load of the engine. Therefore, the exhaust gas from the chamber 46 can be introduced into the chamber 44 via the first exhaust gas passageway 66 with the variable flow area, as shown by other arrow D, and via the second exhaust gas passageway 68 with the constant flow area as shown by the arrow E. Accordingly, when the engine is operating under a relatively high load, the external EGR ratio which corresponds to the amount of exhaust gas directed to the pressure control valve 10 from the chamber 44 of the flow control valve 40, is increased as shown by the arrow C in FIG. 1, in accordance with the increase of the load, as shown by a dashed line b2 in FIG. 2.

Figure 2:
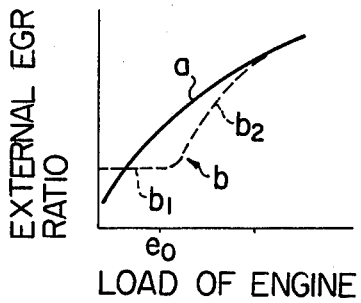
FIG. 2 is a graph containing curves which show the EGR characteristics of the apparatus in FIG. 1.

As can be seen in FIG. 2, the EGR characteristic curve b according to the present invention, which is a combination of the dashed lines $b_1$ and $b_2$, can be approximately coincided with an ideal characteristic curve a during a low load condition. Therefore, an ideal EGR operation can be performed by the apparatus according to the present invention.

Figure 3:
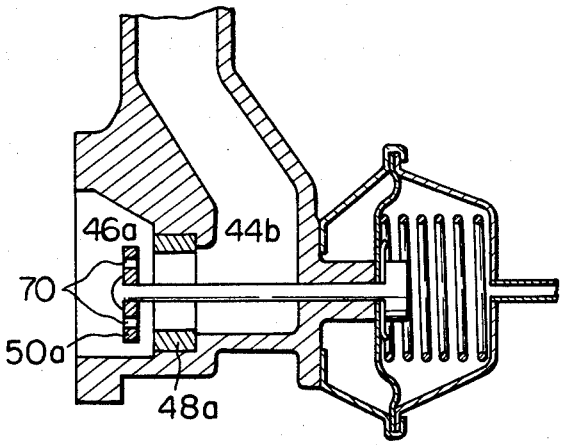
FIG. 3 shows a flow control valve according to another embodiment of the invention.

In another embodiment as shown in FIG. 3, in place of the tubular pipe member 64 of FIG. 1, holes 70 of a small dimension are formed in a valve member **50*a* which faces a valve seat 48*a*. The holes 70 provide an exhaust gas passageway with a constant flow area which performs substantially the same function as the second exhaust gas passageway 68 in FIG. 1. When the engine is operating under a low load in which the valve member 50*a* is rested on the valve seat 48, exhaust gas from a chamber 46*a* is allowed to be introduced into the chamber 44*b* via only the holes 70**. Thereby, an EGR characteristic curve as shown by the dashed line $b_1$ in FIG. 2 is obtained during a low load condition.

Figure 4:
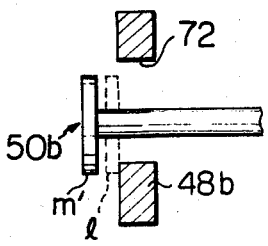
FIG. 4 shows the construction of a valve member and a valve seat of a further embodiment according to the invention.
Figure 5:
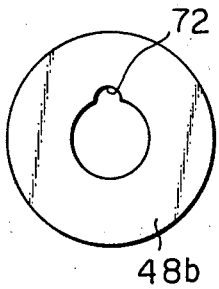
FIG. 5 is a plan view of the valve seat in FIG. 4.

In a further embodiment as shown in FIGS. 4 and 5, a valve seat **48*b* has a recess 72 at an inner opening thereof. The recess 72 forms an exhaust gas passageway of a constant flow area when a valve member 50*b*** is rested on the valve seat during the low load operation as shown by the dotted line e'. Thus, the EGR characteristic curve as shown by the dashed line $b_1$ in FIG. 2 is obtained during a low load operation.

What is claimed is:

1. An exhaust gas recirculation apparatus for an internal combustion engine having an intake system and an exhaust system, said apparatus comprising:

means defining exhaust gas recirculation passageway means fluidly connecting the exhaust system with the intake system;

vacuum-operated pressure control valve means on said exhaust gas recirculation passageway means;

vacuum conduit means for transmitting a vacuum signal from said intake system to said vacuum-operated pressure control valve means;

means responsive to the pressure of the exhaust gas to be recirculated in said exhaust gas recirculation passageway means for controlling the level of the vacuum signal which is transmitted from said intake system to said vacuum-operated pressure control valve means through the vacuum conduit means; and flow control means comprising a valve means including a valve seat arranged in said exhaust gas recirculation passageway means between said pressure control valve means and said exhaust system and including a valve member facing said valve seat, means responsive to vacuum in said intake system for controlling the flow area between said valve seat and said valve member so that said flow area is varied in accordance with the vacuum in said intake system, and means defining an orifice of constant flow area in said passageway means, whereby the amount of exhaust gas directed to said pressure control valve means is varied in accordance with the load on the engine.

2. An exhaust gas recirculation apparatus according to claim 1, wherein said means defining an orifice comprises a tubular member of small dimension in said passageway means connected fluidly in parallel with said valve seat.

3. An exhaust gas recirculation apparatus according to claim 1, wherein said means defining an orifice comprises at least one hole of small dimension through said valve member.

4. An exhaust gas recirculation apparatus according to claim 1, wherein said means defining an orifice comprises at least one recess in said valve seat.

5. An exhaust gas recirculation system for an internal combustion engine having an intake system and an exhaust system, said recirculation system comprising:

a passageway for exhaust gas fluidly connecting the exhaust system to the intake system;

a vacuum operated pressure control valve for controlling flow of exhaust gas from said exhaust system through said passageway to said intake system;

a conduit for transmitting a vacuum signal from the intake system to the pressure control valve;

means responsive to the pressure of the exhaust gas in said passageway for controlling the level of the vacuum signal transmitted from the intake system to the pressure control valve; and flow control means comprising:

a continuously open first flow path in said passageway between said pressure control valve and said exhaust system; and a valve comprising:

a valve seat in said passageway between said pressure control valve and said exhaust system; and a valve member movable toward and away from said valve seat in response to vacuum in said intake system and defining an openable and closable second flow path in said passageway for controlling the flow of exhaust gas through said passageway in accordance with the vacuum in said intake system; whereby the amount of exhaust gas directed from said exhaust system to said pressure control valve is varied in accordance with the load on the engine.

6. An exhaust gas recirculation system for an internal combustion engine having an intake system and an exhaust system, said recirculation system comprising:

a passageway for exhaust gas fluidly connecting the exhaust system and the intake system, said passageway having first and second passages therein fluidly connected in parallel, said first passage being continuously open and having a smaller transverse cross-sectional area than said second passage;

a vacuum operated pressure control valve having a valve member movable to control the flow of exhaust gas from said exhaust system through said passageway to said intake system;

a conduit for transmitting a vacuum signal from said intake system to said vacuum-operated pressure control valve;

a vacuum control valve responsive to the pressure of the exhaust in said passageway for controlling the level of the vacuum signal transmitted from the intake system to the pressure control valve;

said first and second passages being between the exhaust system and said valve member; and a flow control valve comprising a valve seat surrounding said second passage and a second valve member movable toward and away from said valve seat in response to vacuum in said intake system for controlling the flow of exhaust gas through said second passage in accordance with the vacuum in said intake system whereby the amount of exhaust gas directed from said exhaust system to said intake system is varied in accordance with the load on the engine.

7. An exhaust gas recirculation system for an internal combustion engine having an intake system and an exhaust system, said recirculation system comprising:

a passageway for exhaust gas fluidly connecting the exhaust system and the intake system;

a vacuum-operated pressure control valve having a valve member movable to control the flow of exhaust gas from said exhaust system through said passageway to said intake system;

a conduit for transmitting a vacuum signal from said intake system to said vacuum-operated pressure control valve;

a vacuum control valve responsive to the pressure of the exhaust in said passageway for controlling the level of the vacuum signal transmitted from the intake system to the pressure control valve;

a flow control valve between said exhaust system and said valve member, said flow control valve comprising a valve seat surrounding said passageway and a second valve member movable toward and away from said valve seat in response to vacuum in said intake system for controlling the flow of exhaust gas through said passageway in accordance with the vacuum in said intake system; and means defining at least one continuously open passage through said second valve member through which exhaust gas may flow from said exhaust system to said first-mentioned valve member regardless of the position of said second valve member, said passage being of substantially smaller transverse cross-sectional area than the flow area defined by said valve seat.

8. An exhaust gas recirculation system for an internal combustion engine having an intake system and an exhaust system, said recirculation system comprising:

a passageway for exhaust gas fluidly connecting the exhaust system and the intake system, a vacuum-operated pressure control valve having a valve member movable to control the flow of exhaust gas from said exhaust system through said passageway to said intake system;

a conduit for transmitting a vacuum signal from said intake system to said vacuum-operated pressure control valve;

a vacuum control valve responsive to the pressure of the exhaust in said passageway for controlling the level of the vacuum signal transmitted from the intake system to the pressure control valve; and a flow control valve between said exhaust valve system and said valve member, said flow control valve comprising a valve seat surrounding said passageway and a second valve member movable into contact with and away from said valve seat in response to vacuum in said intake system for controlling the flow of exhaust gas through said passageway in accordance with the vacuum in said intake system, said valve seat having a continuously open passage defined therethrough which is not closed by said second valve member when it is in contact with said valve seat, said passage being of substantially smaller transverse cross-sectional area than the remainder of the flow area defined by said valve seat.

* * * * *